United States Patent [19]

Fischer et al.

[11] Patent Number: 4,787,324

[45] Date of Patent: Nov. 29, 1988

[54] AUTOMATIC SEWING DEVICE WITH A SEWING HEAD INCLUDING A ROTARY HOUSING

[75] Inventors: Jochen Fischer, Detmold; Hans Scholl, Oerlinghausen-Lipperreihe, both of Fed. Rep. of Germany

[73] Assignee: Kochs Adler Aktiengesellschaft, Fed. Rep. of Germany

[21] Appl. No.: 70,916

[22] Filed: Jul. 8, 1987

[30] Foreign Application Priority Data

Jul. 31, 1986 [DE] Fed. Rep. of Germany ..... 3625881

[51] Int. Cl.[4] ..... D05B 21/00

[52] U.S. Cl. ..... 112/121.12; 112/220; 112/259; 112/309

[58] Field of Search ..... 112/121.11, 121.12, 112/259, 98, 118, 220, 309, 121.15

[56] References Cited

U.S. PATENT DOCUMENTS 2,203,804 6/1940 Essen .

4,373,458 2/1983 Dorosz et al. ..... 112/121.12

4,553,489 11/1985 Landwehr ..... 112/121.12

4,574,718 3/1986 Scholl et al. .

4,719,864 1/1988 Barrett et al. ..... 112/121.12

*Primary Examiner*—Andrew M. Falik

*Attorney, Agent, or Firm*—Laff, Whitesel, Conte & Saret

[57] ABSTRACT

At an automatic sewing device the sewing head for generating a tangential movement of the needle feed movement relative to the seam to be produced is provided with a rotary housing for receiving a needle bar, a needle jogging mechanism and a thread take-up lever drive, and a rotatable hook bearing for receiving a hook. In order to achieve constant stitch lengths even when the rotary housing and hook bearing are swivelled, the main drive shaft for the stitch forming instruments and the adjusting shaft for the rotary housing and the hook bearing are coupled via a differential gear in such a manner that at rotations of the adjusting shaft a swivelling motion is imparted to the main drive shaft, which acts against changes of the position of the needle bar, the needle jogging mechanism, the thread take-up lever drive and the hook.

5 Claims, 4 Drawing Sheets

AUTOMATIC SEWING DEVICE WITH A SEWING HEAD INCLUDING A ROTARY HOUSING

FIELD OF THE INVENTION

In general this invention relates to an automatic sewing device for generating a stitch contour in a workpiece according to a pre-given program.

In particular this invention relates to an automatic sewing device with a sewing head and a device for generating a two-axis-relative movement between the sewing head and the workpiece to be sewn wherein the sewing head is provided with a rotary housing supported at the sewing head and drivable in a swivelling manner by an adjusting shaft, said rotary housing having a needle bar with a needle supported in the rotary housing and reciprocatingly drivable via a crank drive driven by a common drive, which in turn is driven by a main drive shaft of the sewing head, a needle jogging gear connected to the crank drive for generating a needle feed movement, and a thread take-up lever drive coupled to the crank drive for the needle bar. A hook bearing is drivable in a swivelling manner by the adjusting shaft about a common axis of the needle and the hook bearing respectively equiangularly to the rotary housing. A hook is arranged in the hook bearing and drivable by the main drive shaft. Furthermore, a drive motor for driving the main drive shaft and an adjustable drive for driving the adjusting shaft are provided.

BACKGROUND OF THE INVENTION

U.S. Pat. No. 4,574,718 shows such an automatic sewing device, wherein the needle feed movement is always tangentially directed with respect to the seam at the individual position of stitch formation, so that no mentionable forces of displacement between the workpiece and the needle occur. At such a known automatic sewing device there exists the problem that at a rotation of the rotary housing and the hook bearing, the needle bar, the needle jogging drive, and thread take-up lever mechanism and the hook will be altered in their positions relative to each other resulting in stitch length variations. These variations increase proportionally with the angle of rotation per stitch about which the rotary housing and the hook bearing are swivelled. This problem also occurs when, for example, a swivelling of the rotary housing and the hook bearing should be carried out while the needle has come to a standstill within the workpiece, because the needle due to the needle jogging mechanism is exposed to a lateral jogging motion. Due to this problem it is not possible to generate a so-called corner stitch, which may occur as a decorative stitch for example at a shirt collar.

U.S. Pat. No. 2,203,804 shows a two-needle sewing machine, which serves for the production of so-called cork-screw thread seams. At such machines positively and non-avoidably the length of the stitch will be altered at a bent contour of the seam to be produced. The reason for this is the fact that at these sewing machines the swivelling axis of the stitch forming tools does not coincide with the individual axis of the separate needles. For this reason the driving phase between hook and needle alters. Due to this problem in a shaft of a hook swivelling drive there must be interposed a differential gear, which maintains the drive phase of the stitch forming tools to each other. The problems arising at such sewing machines are totally different to the aforedescribed problems

SUMMARY OF THE INVENTION

It is a main object of the invention to provide an automatic sewing device of the type described above, in which swivelling movements of the rotary housing and the hook bearing do not influence the position of the stitch forming tools. This object is achieved by coupling the main drive shaft and the adjusting shaft via a differential gear in such a manner that at rotations of said adjusting shaft a swivelling movement is imparted to the main drive shaft which compensates changes of position of the needle bar, the needle jogging gear, the thread take-up lever drive and the hook. It is an important feature of the invention that the rotary housing and the hook bearing are arranged behind a differential gear so that at equiangular swivelling of the rotary housing and the hook bearing on one hand the needle bar drive, the needle jogging drive and the thread take-up lever drive mechanism and the hook on the other hand will be set in the same manner, so that within the rotary housing on one hand a compensation of movement of the mentioned parts is achieved with is caused by the swivelling motions. The drive motor and the servo motor act upon the differential gear. The drive power portion as well as the adjusting power portion are fed through the differential gear.

Numerous further advantages and features of the invention will become apparent from the following description of an embodiment with reference to the drawing.

DETAILED DESCRIPTION OF THE EMBODIMENT

Figure 1:
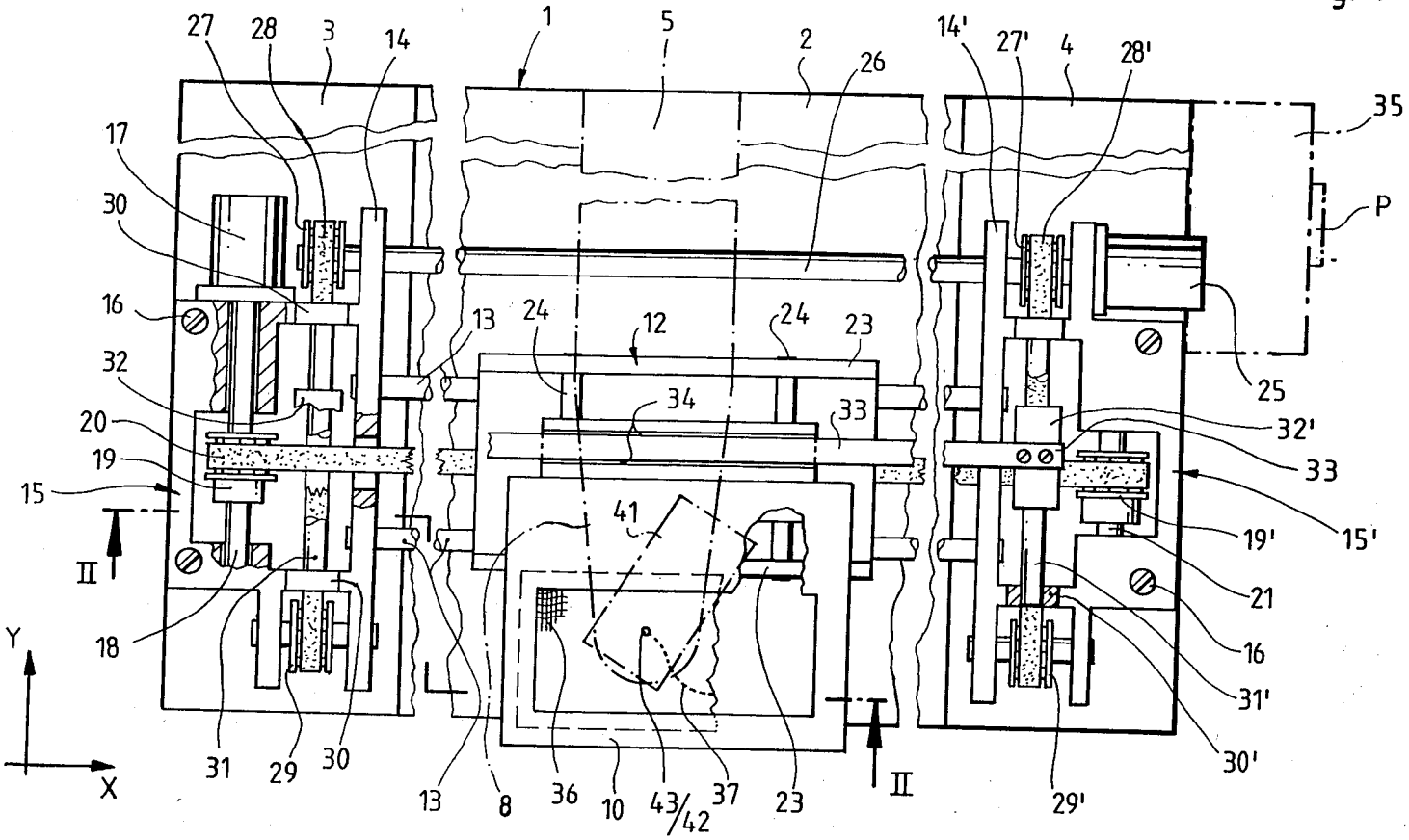
FIG. 1 is a top plan view of an automatic sewing device according to the invention in the direction of arrow I in FIG. 2, a sewing head only being indicated by dot-dash lines.

Referring to the drawings there is illustrated an automatic sewing device mounted to a stand 1 comprising an intermediate section 2 and two lateral sections 3 and 4. On the intermediate section 2 of the stand 1 there is arranged a sewing head 5, the base plate 6 of which is mounted to the intermediate section 2. The sewing head 5 is formed with a standard 7 extending upwardly from the base plate 6, and an upper arm 8 extending from the standard 7 in parallel with respect to the base plate 6. In the area of the free ends of the base plate 6 and the upper arm 8 there are arranged stitch forming instruments 9. Between the base plate 6 and the upper arm 8, i.e. in the area of the stitch forming instruments 9, there is arranged a workpiece holder 10 movable into two directions of coordinates, i.e. in y-direction corresponding to the main direction of the sewing head 5, and in x-direction extending perpendicularly thereto as obvious from FIG. 2. The workpiece holder 10 is associated to an x-y-carriage-system. This system provides a y-carriage 11 and an x-carriage 12, wherein the workpiece holder 10 is directly connected to the y-carriage 11. The y-carriage 11 is supported and guided on the x-carriage 12 and displaceable in y-direction relative to the x-carriage 12. The x-carriage 12 is displaceable in x-direction relative to the stand 1. Consequently, the y-carriage 11 together with the workpiece holder 10 is displaceable in x- and y-direction relative to the stand 1.

The x-carriage 12 is displaceably arranged on two guide rods 13, which are stationarily mounted to the stand 1 and which extend parallel to each other. The guide rods 13 are received with each of their ends in bearing webs 14, 14' of bearing blocks 15, 15' mounted to the two lateral sections 3 and 4, respectively, of the stand 1 by means of screws 16.

Figure 2:
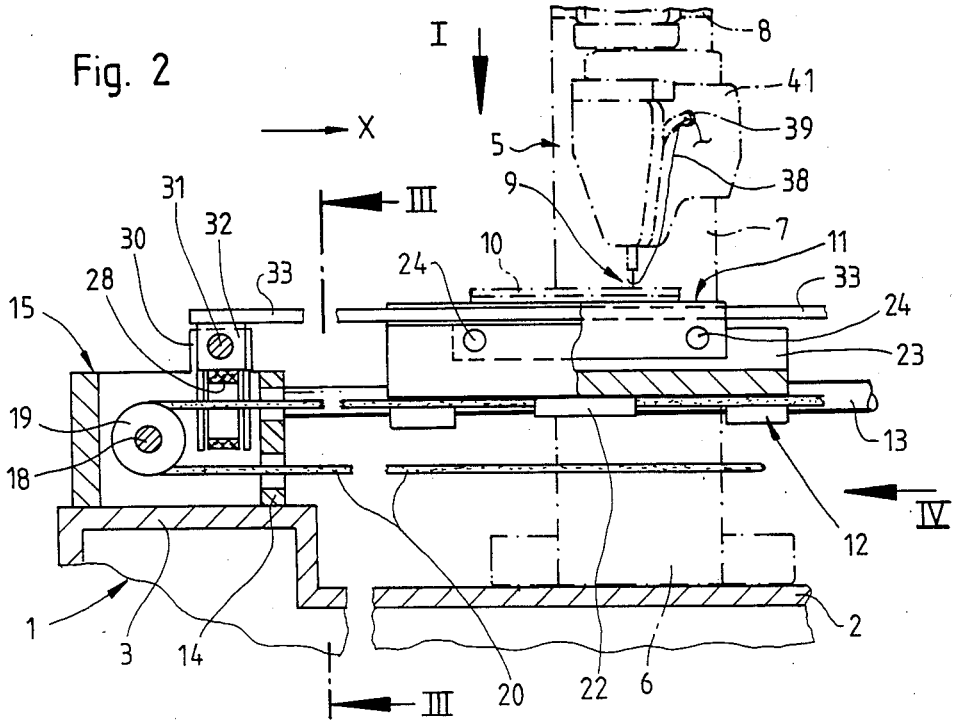
FIG. 2 is a vertical partial section taken along line II—II in FIG. 1.
Figure 3:
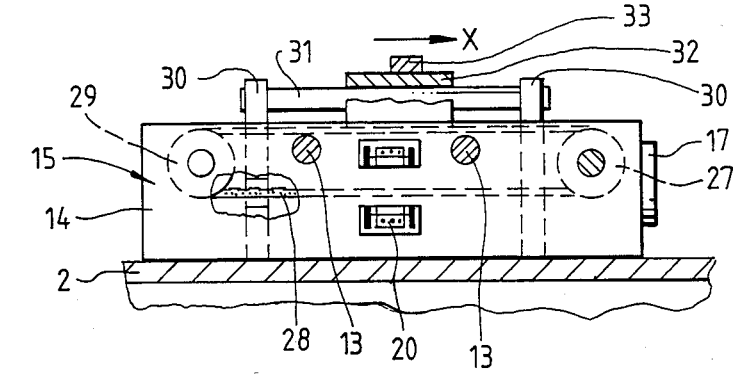
FIG. 3 is a vertical partial cross-section taken along line III—III in FIG. 2.
Figure 4:
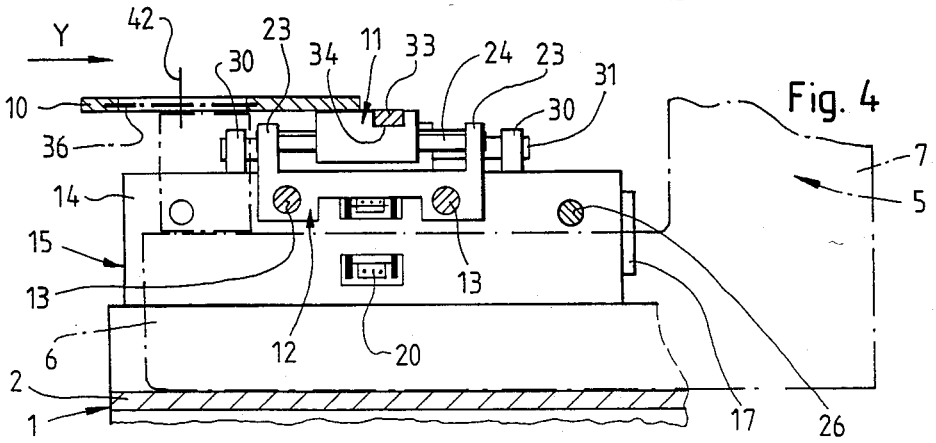
FIG. 4 is a partial side elevation in the direction of arrow IV in FIG. 2.

To one bearing block 15, which is shown in FIGS. 1 and 2 associated to the left lateral section 3, there is mounted a drive motor 17 for the x-carriage 12. This motor 17 drives a timing belt pulley 19 via a shaft 18, which is supported in the bearing block 15. The timing belt pulley 19 in turn drives an endless timing belt 20 via a timing belt pulley 19'. The timing belt pulley 19' is rotatably supported via an axis 21 in the bearing block 15' located in the right lateral section 4 of the stand 1. The upper strand of the timing belt 20 is secured to the lower surface of the x-carriage 12 by means of a fastening means 22, so that the x-carriage 12 may be displaced on the guide rods 13 in x-direction when correspondingly driven by the drive motor 17. The x-carriage 12 is provided with side walls 23, which extend in x-direction and carry guide rods 24 extending in y-direction. The y-carriage 11 is supported on the guide rods 24 and displaceable in y-direction.

The drive of the y-carriage 11 is accomplished by a drive motor 25. The drive motor 25 is mounted to the bearing block 15' and directly drives a shaft 26 supported in the two bearing blocks 15, 15'. The shaft 26 extends in x-direction. In both bearing blocks 15, 15' timing belt pulleys 27 and 27', respectively, are fixedly mounted to the shaft 26, i.e. the timing belt pulleys 27 and 27', respectively, are rotatingly drivable by the shaft 26. These timing belt pulleys 27 and 27', respectively, each drive an endless timing belt 28 and 28', respectively. Each of the timing belts 28, 28' is guided via timing belt pulleys 29, 29' also supported in the bearing block 15 and 15', respectively. In parallel with and above the timing belts 28, 28' guide rods 31, 31' are mounted in webs 30, 30' of each bearing block 15, 15'. To each of the guide rods 31, 31' there is mounted a slide bearing 32 and 32', respectively, displaceable in y-direction. The two slide bearings 32, 32' arranged oppositely to one another are connected by a guide bar 33 extending in x-direction. Each end of the guide bar 33 is screwed to the corresponding slide bearing 32 or 32', respectively. The guide bar 33 engages a guide groove 34, which is located in the upper surface of the y-carriage 11 and which is matched to the outer circumference of the guide bar 33. The guide groove 34 and the guide bar 33 have no clearance in the y-direction, but they are displaceable to each other in their longitudinal directions, i.e. in x-direction. Due to the drive of the guide bar 33 in y-direction, i.e. transversally with respect to its longitudinal direction, by means of the timing belts 28, 28' engaging the two ends of the guide bar 33 via the slide bearings 32, 32' a canting-free drive of the y-carriage 11 in y-direction is achieved. Movements of the y-carriage 11 together with the x-carriage 12 in x-direction are possible without problems since the guide bar 33 absolutely extends in parallel with the guide rods 13, while a correct drive and a correct guidance in y-direction is achieved due to the fact that the guide rods 31, 31' absolutely extend in parallel with the guide rods 24.

The drive motors 17 and 25 may be designed as step motors or DC-motors with position feed-back, which effect a very precise program-controlled drive of the x-carriage 12, the y-carriage 11 and thus the workpiece holder 10 in x-y-direction.

For the program-controlled drive there is provided a control unit 35 with a receptacle for a program P. In the workpiece holder 10 there is clamped a workpiece 36, in which is produced a seam 37 by means of the stitch forming instruments 9 as will be described hereinafter. For producing the seam 37, a needle thread 38 is guided from a spool (not shown) via a thread take-up lever 39 to the stitch forming instruments 9.

Figure 5:
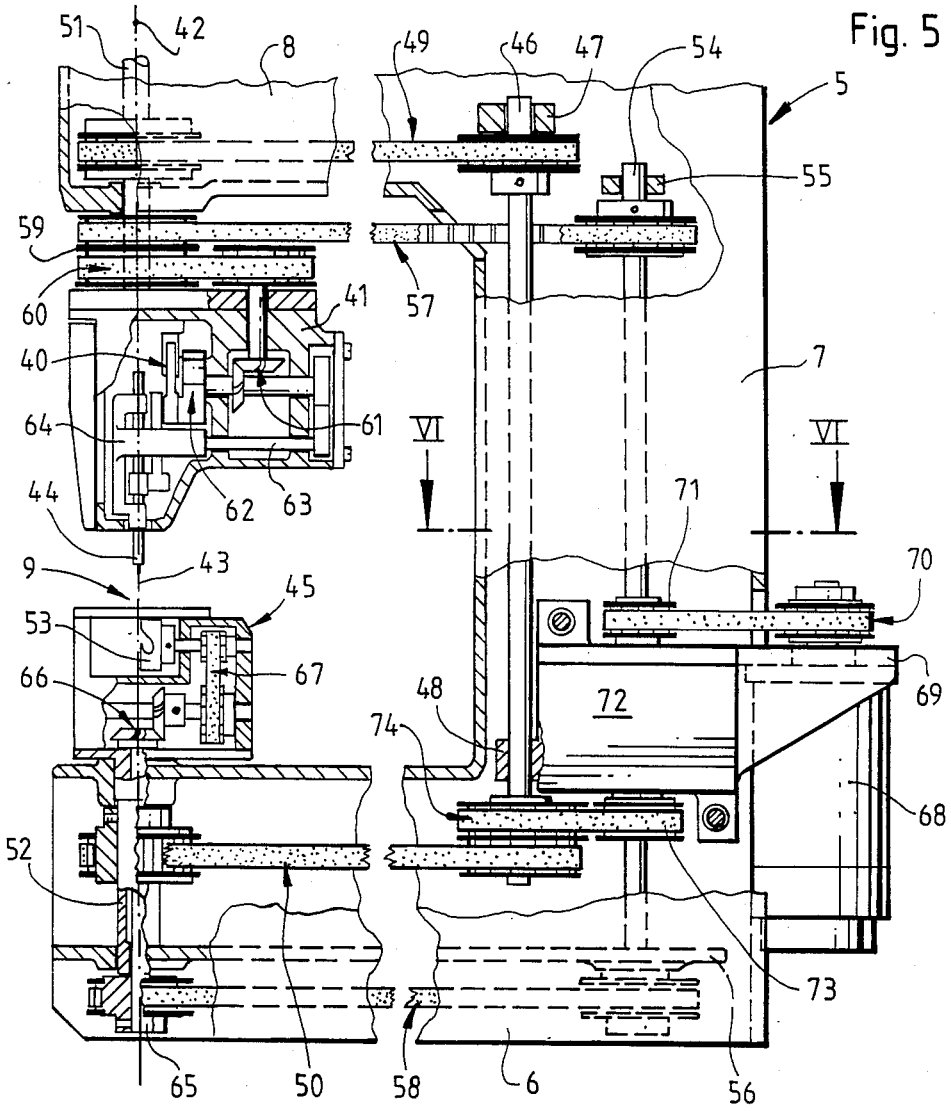
FIG. 5 is a vertical section through the sewing head, an upper arm of which being partially broken away.

The construction of the sewing head 5 substantially is obvious from FIG. 5. At the lower surface of the free end of the upper arm 8 there is supported a rotary housing 41 rotatable about an axis 42. Aligned to this axis 42 there is arranged a needle bar 44 carrying a needle 43. Below the rotary housing 41 and also flush with the axis 42 there is arranged a hook bearing 45 on the base plate 6 formed as a housing. The hook bearing 45 is equiangularly swivelling or rotating together with the rotary housing 41. The swivel drive of the rotary housing 41 and the hook bearing 45 is effected by an adjusting shaft 46. The adjusting shaft 46 is supported in bearings 47, 47' of the standard 7 and extends in parallel with the axis 42. From both ends of the adjusting shaft 46 timing belt drives 49, 50 are driven. The timing belt drive 49 arranged in the upper arm 8 drives the rotary housing 41 via a shaft 51 concentrically arranged with respect to the axis 42. The lower timing belt drive 50 arranged in the base plate 6 drives the hook bearing 45 via a hollow shaft 52. As the two timing belt drives 49, 50 have an identical transmitting ratio, both, the rotary housing 41 and the hook bearing 45, are equiangularly driven.

The needle bar 44 together with the needle 43 on one hand and the hook 53 in the hook bearing 45 on the other hand are driven by a common drive shaft 54 serving as a main drive shaft. The shaft 54 is supported in the standard 7 by means of bearings 55, 56 and extends in parallel with the adjusting shaft 46. The shaft 54 drives the needle bar 44 and the hook 53 via timing belt drives 57, 58 each located in the area of the ends of the drive shaft 54. The upper timing belt drive 57 associated to the upper arm 8 terminates in a double timing belt pulley 59 arranged concentrically with respect to the shaft 51 and thus with the axis 42. This pulley 59 is not connected to the shaft 51. The double timing belt pulley 59 drives via a further timing belt drive 60 located on the upper surface of the rotary housing 41, a bevel gear drive 61 situated in the rotary housing 41. The bevel gear drive 61 in turn drives a crank drive 62, which imparts oscillatory motions to the needle bar 44. Furthermore, the bevel gear drive 61 drives via a rocking shaft 63 a needle bar jogging frame 64, which imparts vibratory motions—so-called needle feed movements—to the needle bar 44. Moreover, the crank drive 62 also drives a thread take-up lever drive mechanism 40 for driving the thread take-up lever 39.

The lower timing belt drive 58 arranged in the base plate 6 drives a hook drive shaft 65 located in the hollow shaft 52. The hook drive shaft 65 drives the hook 53 via a bevel gear drive 66 provided in the hook bearing 45, and a further timing belt drive 67. The design and the drive of the rotary housing 41 inclusive the needle bar 44 supported therein, of the needle bar jogging frame 64 and of the thread take-up level drive mechanism 40 as well as the design and the drive of the hook bearing 45 inclusive the drive of the hook 53 located in the latter by the adjusting shaft 46 and the drive shaft 54, respectively, are known from U.S. Pat. No. 4,574,718, reference to which is expressively made in order to avoid repetitions.

For driving there is provided a drive motor 68 mounted to a flange 69 of the stand 7. From the drive motor 68 leads a timing belt drive 70 to the input of a differential gear 72 which input is formed as a timing belt hollow wheel 71. An adjusting output of the differential gear 72 is formed as a timing belt hollow wheel 73 and drives the adjusting shaft 46 via a timing belt drive 74. The drive shaft 54 passing through the hollow wheels 71, 73 is also driven by the differential gear 72. In order to avoid changes of the position of the needle and thus changes of the stitch lengths, the purpose of the differential gear 72 is to compensate changes of the position of the needle bar 44 and the hook 53 due to rotations of the rotary housing 41. This compensation is achieved by a counter-directed rotation of the drive shaft 54. Changes of the stitch length would occur as the needle 43—depending on the angle and amplitude of rotation of the rotary housing 41 and the hook 53—sooner or later would enter the workpiece 36 relative to the movement of the workpiece 36.

With the hollow timing belt wheel 71 forming the input of the differential gear 72 there is rotatably fixed a sun wheel 75 serving as a gear which rotatably surrounds the drive shaft 54.

The sun wheel 71 drives gear wheels serving as planet pinions 76. These planet pinions 76 are rotatably supported on axle journals 77, which in turn are fixedly mounted to a worm gear 78. The worm gear 78 is concentrically and freely rotatably arranged on the drive shaft 54. Thus, the worm gear 78 serves as a planet pinion carrier arcogl. The axle journals 77 extend in parallel with the drive shaft 54. To the planet pinions 76 there are coaxially and non-rotatably connected pinions 79, the diameters of which are smaller than those of the planet pinions 76. The pinions 79 mesh with a gear wheel 80 non-rotatably connected to the drive shaft 54. All wheels 75, 76, 79, 80 are arranged in planes extending in parallel to each other, i.e. all wheels have an axis parallel to each other. The diameter D' of the gear wheel 80 is larger than the diameter d of the sun wheel 75 by an amount, by which the diameters d' of the pinions 79 are smaller than the diameters D of the planet pinions 76, i.e. $D+d=d'+D'$ or $D'-d=D-d'$. The gear wheels 75, 76 are of the same size, so that they form a gear ratio of transmission of "one". In contrast to this, the pinion 79 is formed smaller than the gear wheel 80, so that there is a gear ratio of transmission of "unequal one".

The worm gear 78 is engaged with a worm shaft 82, which is supported in a housing 81 of the differential gear 72. The worm shaft 82 is connected via a clutch 83 to a servo motor 84, which is also secured to the housing 81. The worm gear 78 is supported in a bearing 85 in the housing 81 and rotatably supported on the drive shaft 54. Thus, also the spatial arrangement of the planet pinions 76 and the pinions 79 connected thereto, is defined. The timing belt hollow wheel 71 together with the sun wheel 75 is supported in a bearing 86 located in a cover 87 of the housing 81. The cover 87 is firmly secured to the housing 81 and precisely centered with respect to the latter by means of a spigot 88.

Figure 8:
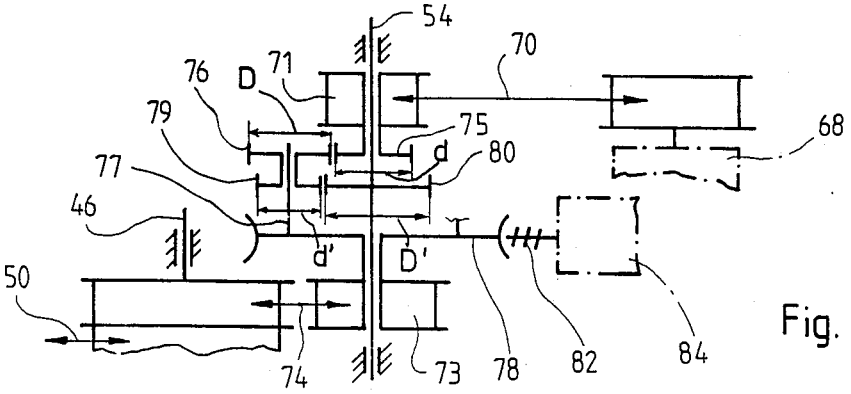
FIG. 8 is a schematic representation of the differential gear.
Figure 6:
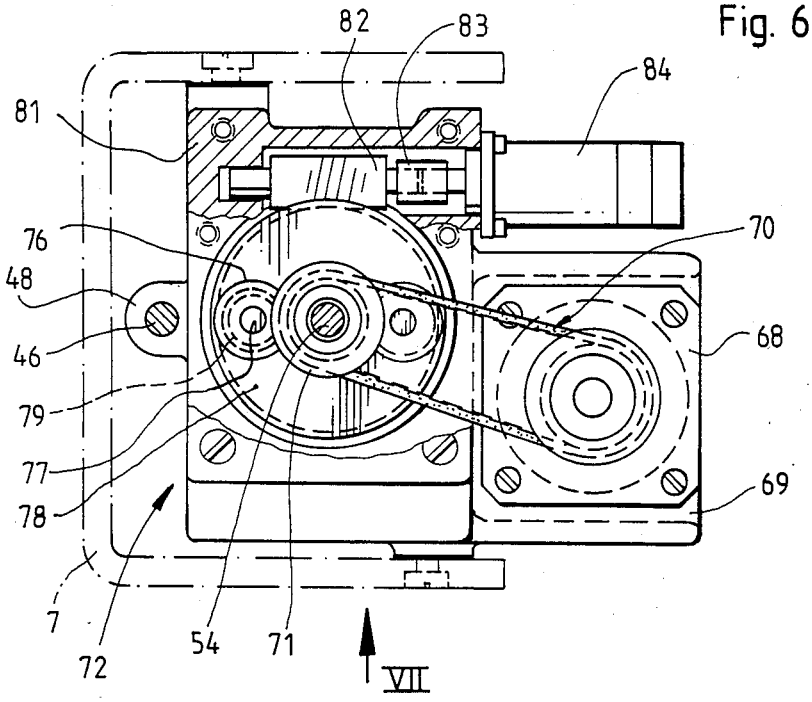
FIG. 6 is a cross-section through a standard of the sewing head taken along line VI—VI in FIG. 5, showing a differential gear partially in a broken-open view.
Figure 7:
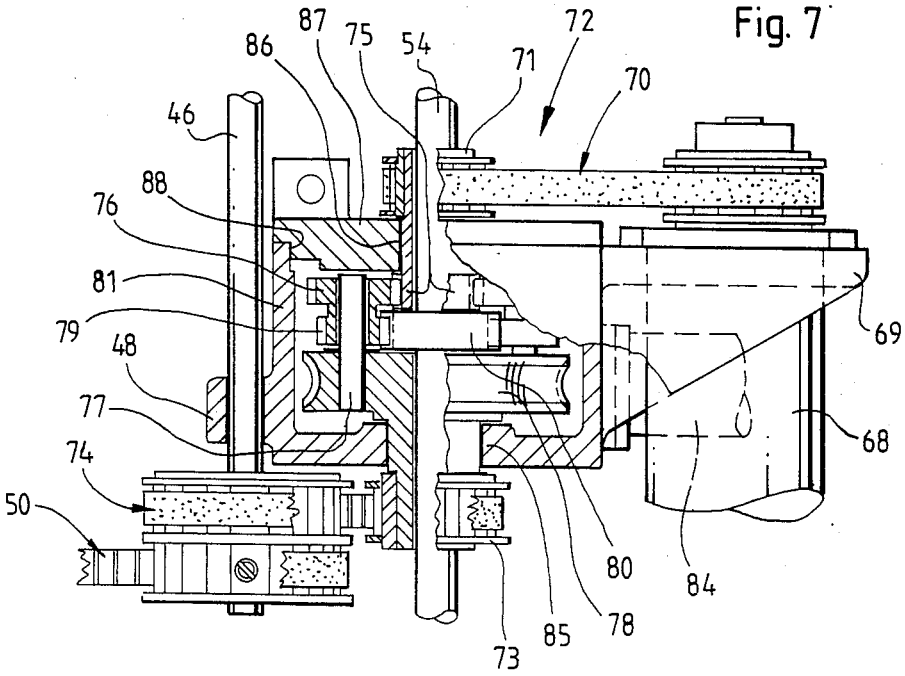
FIG. 7 is a side elevation of the differential gear in the direction of arrow VII in FIG. 6, partially in a broken-open view.

Hereinafter the operation will be described with reference to the schematic representation in FIG. 8.

It is assumed that the servo motor 84 stands still, so that the worm wheel 78 is not driven. Consequently, also the adjusting shaft 46 is not driven via the timing belt drive 74 and the timing belt hollow wheel 73 non-rotatably connected to the worm wheel 78 and forming the output of the differential gear 72. The sun wheel 75 drives the planet pinions 76 supported on the axle journals 77. From here the drive of the gear wheel 80 is initiated by the pinions 79, whereby the drive shaft 54 in turn is driven. As resulting from the above description, the drive shaft 54 is driven with a lower RPM-rate than the timing belt hollow wheel 71 forming the input of the differential gear 72. Since the adjusting shaft 46 is not driven, the rotary housing 41 and the hook bearing 45 stand still. Only a regular sewing operation will be performed by the drive of the needle bar 44 with the needle 43 along with the simultaneous operation of the needle jogging drive and the hook 53. At such a plain sewing operation, in which the rotary housing 41 and the hook bearing 45 are not swivelled or rotated respectively, there will be no problems of an undesired change of stitch lengths.

When the main drive formed by the drive motor 68 stands still, but the servo motor 84 is actuated, the timing belt hollow wheel 73 serving as the output of the differential gear 72 is directly driven via the worm wheel 78. This, in turn, causes the drive of the adjusting shaft 46 via the timing belt drive 74 and subsequently the equiangular and equally directed swivel movement of the rotary housing 41 and the hook bearing 45 about the axis 42 via the timing belt drives 49 and 50, respectively. If the drive shaft 54 together with the timing belt drives 57 and 58 were kept firm, then the needle bar 44 and also the needle bar jogging frame 64 would carry out a movement due to a roll-off movement of the timing belt drive 60 on the double timing belt pulley 59. Likewise the hook 53 would rotate due to a roll-off movement in the bevel gear drive 66. This would result in the already above mentioned change of the position of the needle 43 and the hook 53, which, at an operated sewing machine, would cause a change of the stitch length. The change of the stitch length would be larger, the larger the angle of rotation of the rotary housing 41 and the hook bearing 45 per stitch are. This undesired change of position of the needle bar 44, of the needle bar jogging frame 64, of the thread take-up lever drive 40 and of the hook 53 is compensated by the fact that the axle journals 77 connected to the worm wheel 78 are rotated with the worm wheel 78, and thus imparting an additional compensational rotary movement to the drive shaft 54. This results from the different diameters of the planet pinions 76 and the pinions 79 and the different gear ratios presented thereby. Therefore, a rotary movement is imparted to the drive shaft 54, resulting in a compensation of the above mentioned undesired change of position of the needle bar 44 with the needle bar jogging frame 64 and the hook bearing 45.

During a sewing operation, i.e. at running drive motor 68 and a swivelling movement of the rotary housing 41 and the hook bearing 45, the afore-described sequences of movements superpose each other.

The seam 37 to be produced in the workpieces 36 clamped in the workpiece holder 10 is achieved by the fact that needle feed movement of the needle 43 is controlled always tangentially with respect to the contour of the seam 37 as described in detail in the already mentioned U.S. Pat. No. 4,574,718. The control of the drive motor 68 serving as main drive, of the servo motor 84 and also of the drive motors 17 and 25 for the carriages 11, 12 with the workpiece holder 10 is effected by the programmable computer 35 according to the program P to be given in.

What is claimed is:

1. An automatic sewing device with a sewing head (5) and a device for generating a two-axis-relative movement between the sewing head (5) and a workpiece (36) to be sewn, said sewing head (5) including:

a rotary housing (41) supported at said sewing head (5) and drivable in a swivelling manner about an axis of rotation by an adjusting shaft (46), said rotary housing (41) having:

a needle bar (44) with a needle (43) supported in said rotary housing (41) and reciprocatingly drivable via a crank drive (62) driven by a common drive, which common drive is drivable by a main drive shaft (54) of said sewing head (5), the needle having a needle axis (42) being identical with said axis of rotation, a needle jogging gear (63, 64) connected to said crank drive (62) for generating a needle feed movement, and a thread take-up level drive (40) coupled to said crank drive (62), a hook bearing (45) drivable in a swivelling manner by said adjusting shaft (46) about said needle axis (42) equiangularly to said rotary housing (41), a hook (53) arranged in said hook bearing (45) and drivable by said main drive shaft (54), a drive motor (68) for driving said main drive shaft (54), an adjusting drive (84) for driving said adjusting shaft (46), and said main drive shaft (54) and said adjusting shaft (46) being coupled via a differential gear (72) in such a manner that at rotations of said adjusting shaft (46) a swivelling movement is imparted to the main drive shaft (54) which compensates changes of position of said needle bar (44), said needle jogging gear (63, 64), said thread take-up lever drive (40) and said hook (53).

2. An automatic sewing device according to claim 1, wherein said differential gear (72) is provided with a sun wheel (75) drivable by said drive motor (68) and in driving connection to said main drive shaft (54), and at least on planet pinion meshing with said sun wheel (75), said planet pinion (76) being supported on a pinion cage (78) rotatably drivable by said adjusting drive (84), and driving said main drive shaft (54).

3. An automatic sewing device according to claim 2, wherein said pinion cage is formed as a worm gear (78) and drivable by a servo motor (84) serving as said adjusting drive.

4. An automatic sewing device according to claim 2, wherein to said at least one planet pinion (76) is coaxially connected a pinion (79) meshing with a gear wheel (80), said gear wheel (80) being fixedly mounted on said main drive shaft and coaxially arranged with said sun wheel.

5. An automatic sewing device according to claim 4, wherein a diameter (d) of said sun wheel (75) is unequal to a diameter (D') of said gear wheel (80)

* * * * *